United States Patent [19]

Ford et al.

[11] 4,141,061

[45] Feb. 20, 1979

[54] VANDAL-RESISTANT FLUORESCENT FIXTURE

[76] Inventors: Lloyd W. Ford; Daniel R. Ford, both of 1465 N. Carolan Ave., Burlingame, Calif. 94010

[21] Appl. No.: 800,407

[22] Filed: May 25, 1977

[51] Int. Cl.[2] ..... F21V 15/00; F21V 21/02

[52] U.S. Cl. ..... 362/216; 362/147; 362/260; 362/310; 362/368; 362/414; 362/431

[58] Field of Search ..... 362/147, 216, 288, 310, 362/368, 414, 431, 260

[56] References Cited

U.S. PATENT DOCUMENTS

| | | | |
|---|---|---|---|
| 2,494,058 | 1/1950 | Ries et al. | 362/216 |
| 3,064,851 | 11/1962 | Guigli | 362/147 X |
| 3,113,728 | 12/1963 | Boyd | 362/147 X |
| 3,366,785 | 1/1968 | Huber, Jr. | 362/310 |
| 3,461,283 | 8/1969 | Hahn | 362/368 X |
| 3,742,208 | 6/1973 | Mills | 362/216 |

*Primary Examiner*—Richard D. Lovering
*Attorney, Agent, or Firm*—Julian Caplan

[57] ABSTRACT

The cover for the fixture comprises an opaque base having a cylindrical outer wall formed with a slightly lesser-diameter neck terminating in an outward-extending bead. Fitting on the base is a translucent cover having a truncated conical top and a cylindrical wall of the same diameter as the base. The rim of the cover wall has an inward extending bead and a groove inward of the bead. The beads of cover and base interfit to prevent separation except at one location where the base bead is interrupted and there is a slot in the outer wall for a blade or coin to be inserted to pry the cover off. The cover and base are of impact-resistant, slightly flexible plastic. Within the base is a metal mounting for a ring-type fluorescent lamp and its ballast and starter and also a fitting for mounting the base on a wall or ceiling or on an adapter to fit on a pole.

4 Claims, 7 Drawing Figures

VANDAL-RESISTANT FLUORESCENT FIXTURE

This invention relates to a new and improved vandal-resistant mounting for fluorescent lighting fixtures particularly fixtures installed in the hallways and other public areas of apartment houses and industrial and commercial buildings. In such installation, there is considerable vandalism. One type of vandalism is breakage of the fixtures by hitting them with sticks and other implements. Such type of vandalism is resisted in accordance with the present invention by making the exposed portion of an impact resistant plastic material.

A second type of vandalism is caused by opening the cover of the fixture and removing the bulb or lamp. In accordance with the present invention, opening the fixture is extremely difficult for one not understanding how to obtain access for an opening tool.

Still another distinguishing feature of the present invention is the fact that the fixture employs a ring-type fluorescent tube. Such a tube has considerable energy conservation as compared with incandescent bulbs. In addition to maintenance, bulb replacement is considerably reduced. The reduction in heat resulting from use of fluorescent fixtures reduces wire deterioration. In addition, the number of fixtures required in an area may be reduced.

A still further feature of the invention is the ease with which it may be installed either on a wall, ceiling or on top of a pole. In any of these installations there is sufficient air circulation so that the heat given off by the fixture is less than that given off by a 75 watt incandescent bulb in a similar installation.

Other objects of the present invention will become apparent upon reading the following specification and referring to the accompanying drawings in which similar characters of reference represent corresponding parts in each of the several views.

Figure 1:
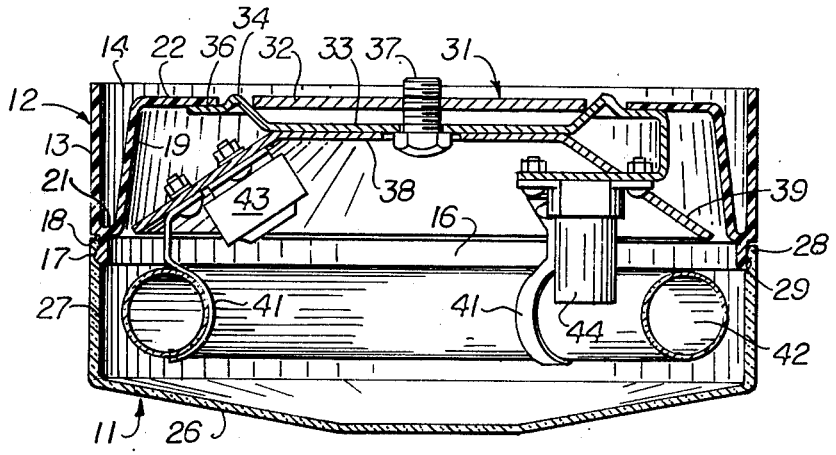
FIG. 1 is a vertical sectional view through a ceiling-mounted fixture in accordance with the present invention.

The externally visible portions of the fixture of the present invention comprise a cover 11 of translucent material and preferably white and a base 12 which is mounted by means hereinafter described upon a ceiling, wall or pole and is preferably relatively opaque. Both the cover 11 and base 12 are preferably formed of an impact resistant, slightly flexible plastic material. Such construction resists breakage by striking the fixture with an instrument and also permits the cover 11 to snap onto the base 12 and to resist removal therefrom, all as hereinafter appears.

Directing attention now to the structure of base 12, there is a cylindrical outer wall 13, the edge 14 of which fits tightly against a wall or ceiling. At the end of wall 13 opposite edge 14 is an inset projecting portion 16 formed at its terminus with an outward extending bead 17, there being an outer shoulder 18 at the base of projection 16. Base 12 has an inward slanted wall 19 which is connected to the wall 13 by a transverse connecting portion 21. An in-turned annular flange 22 is formed on wall 19, being parallel to but inset from the edge 14. At one location the bead 17 is formed with an interruption 23, and immediately below the interruption 23 is a slot 24 in wall 13, both for the purpose of removing the cover 11 as hereinafter explained.

Figure 2:
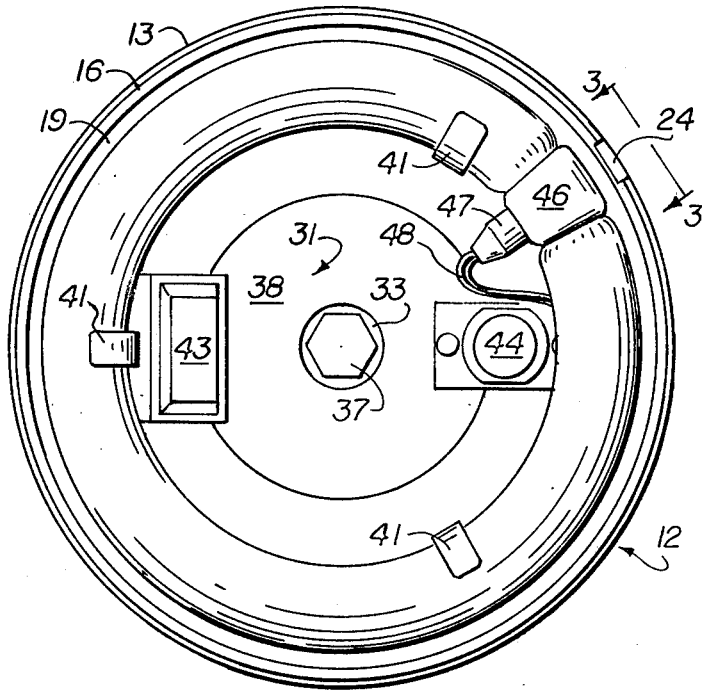
FIG. 2 is a bottom plan view of the structure of FIG. 1 with the cover removed.
Figure 4:
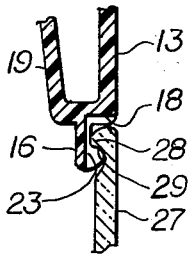
FIG. 4 is a sectional view taken substantially along the line 4—4 of FIG. 3.
Figure 3:
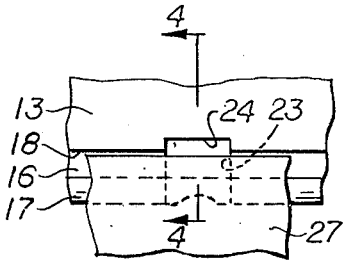
FIG. 3 is an enlarged fragmentary view along the line 3—3 of FIG. 2.
Figure 5:
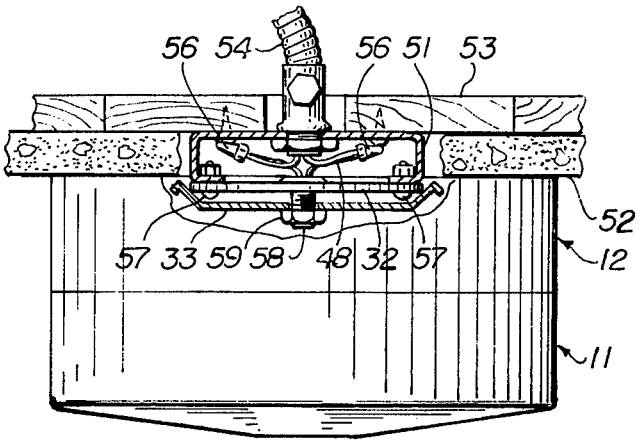
FIG. 5 is a side elevational view partly broken away in section to reveal attachment of the fixture to a junction box in a ceiling.

Cover 11 has a truncated conical top 26 which merges with a cylindrical wall 27 of the same outside diameter as wall 13. The terminus of wall 27 is an inward facing bead 28 and inward of bead 28 is a groove 29. As best shown in FIG. 4, bead 28 fits under the bead 17 and rests against the shoulder 18 while the bead 17 fits into the groove 29. The materials of construction of at least the cover 11 are sufficiently flexible so that the bead 28 snaps over the bead 17 and permits the cover 11 to set on the base 12 as shown in FIG. 1. When it is necessary to remove cover 11, a blade such as a screw driver blade or a coin may be inserted in the slot 24 and twisted. Since the bead 17 is formed with an interruption 23 at this point, and since the parts are flexible, the cover 11 will be snapped off the base 12. As best shown in FIG. 1, a fixture mounting 31 for attachment of base 12 to a ceiling or to a wall is provided. Although subject to some variations, in the preferred form shown there is an outer disk 32 which fits flush against the junction box 51, as shown in FIG. 5, or other wall or ceiling mounting. The disk 32 is apertured for screws 57 or other means of attachment. Inward of disk 32 is inner disk 33 which, in the form shown in FIG. 1, has a bend 34 which serves to center disk 33 relative to flange 22 and a flange 36 which fits over the edge of flange 22. By tightening bolt 37 (or by other means described with reference to FIG. 5), the disks 32 and 33 may be drawn together with the base 12 accurately centered relative to bolts 37. Fixed to disk 33 is an annular bracket 38 having conical peripheral flange 39. Fixed at three (or more) locations in flange 39 are arcuate clips 41 of a springy material which receive a commercial available ring-type fluorescent lamp 42. The ballast 43 and starter 44 for the lamp 42 are mounted on brackets to flange 39 or other suitable locations. The ring 42 has a socket 46 which receives plug 47 on the end of wiring 48. In the preferred installation (as best shown in FIG. 2), the socket 46 (whch does not give off light) is located opposite the slot 24 so that one who is familiar with the installation knows where the slot 24 is located even though it is above eye level.

FIG. 5 shows installation of the unit in a typical ceiling location. Thus the junction box 51 is set into an opening in the ceiling plaster 52 which is attached to the ceiling 53. It is understood that this installation is typical. A conduit 54 carrying the wires for current is received in the junction box 51 by conventional means. Connectors 56 connect the wires in the conduit 54 to the wires 48. It is apparent in FIG. 5 how the disk 32 is attached by screws or bolts 57 to the junction box 51. In this installation, a nipple 58 is fixed behind the disk 32 and receives the wiring 48 and passes through the inner disk 33 and is held in place by a nut 59. There are many different types of junction boxes 51 and the outer disk 32 is apertured in such manner as to make it compatible with a majority of commercially available junction boxes. However, the disk 32 may be replaced if necessary.

Figure 6:
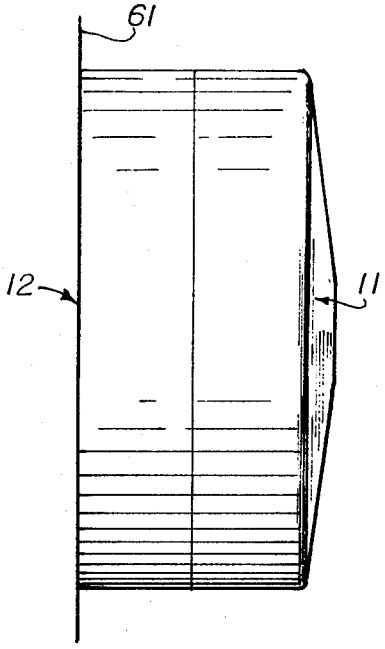
FIG. 6 is a side elevational view showing the fixture installed on a wall.

FIG. 6 shows attachment of the device to a wall. Normally there is a junction box (not shown) in the wall 61 similar to the junction box 51.

Figure 7:
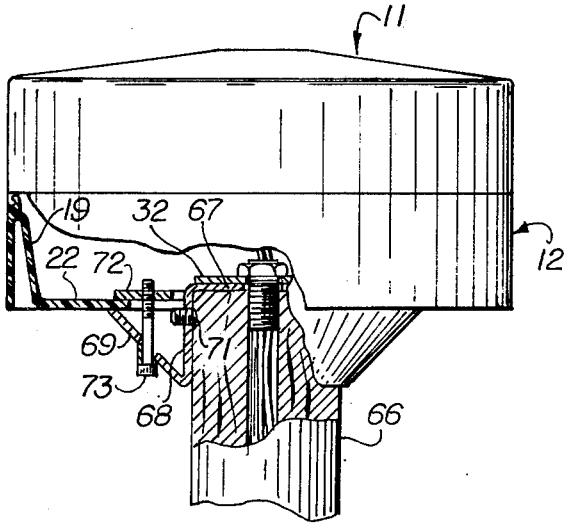
FIG. 7 is a side elevational view broken away in section to reveal attachment of the fixture to the top of a post.

FIG. 7 shows attachment of the device to the top of a post 66 of the type used for outdoor lighting. In this form, the post 66 is shown solid wood, although it will be understood that it may be made of metal tubing. A socket base 67 fits over the top of the post 66 and has a downward extending peripheral cylindrical flange 68 which is attached to the upper end of the post 66 by a plurality of set screws 71. The lower edge of cylinder 68 merges with an upward-outward slanted portion upon which the flange 22 rests. An arcuate wing 72 fits over the flange 22 and is shaped so that it loosely fits against the cylindrical portion 68. A screw 73 is threaded into the wing 72 and is externally accessible. By turning the head of screw 73 the wing 72 may be drawn down to firmly engage the flange 22 and hold the base 12 in place on the top of the post 66.

Other installations will readily occur to one skilled in the art. It will be seen that the device is easily installed by an electrician in any of the multitude of locations where lighting fixtures are required. The device is particularly suitable in public areas, such as apartment houses and industrial and commercial buildings, particularly in locations where vandalism may be prevalent. The cover 11 may be removed by twisting a coin or blade in the slot 24 until the cover snaps off the base. The fluorescent fixture 41 may be installed and the plug 47 inserted in the socket 46. Thereupon, the cover 11 is pressed onto the base 12, the beads 17 and 28 snapping into place. The cover cannot be removed except by one knowing how to do so by inserting a blade through the slot 24.

In the accompanying claims the terms "inner", "upper", "below" are used in the sense of the use of the devices shown in FIG. 1. It will be understood that the device may be inverted or mounted sidewards or at any other angle, and the claims are to be thus interpreted.

What is claimed is:

1. A lighting fixture comprising an integral base having a cylindrical outer wall having a co-planar edge adapted to fit flush against a wall or ceiling, an inset projection on the end of said outer wall opposite said edge, said inset projection being formed with a base bead and a base groove inward of said bead, said base bead being formed with a short, arcuate interrupted portion, , said outer wall being formed with a slot suitable for insertion and twisting of a blade or coin, said slot being immediately inward of said interrupted portion of said bead; an integral translucent cover having a cylindrical outer cover wall of the same diameter as said outer wall of said base, the inner surface of said cover wall being formed with a cover bead and a cover groove inward of said cover bead, said cover bead being adapted to fit in said base groove and said base head being adapted to fit in said cover groove; said base and cover being made of impact-resistant, slightly flexible plastic material; a fixture mounting attached to said base a short distance below said co-planar edge having an uppermost outer disk shaped for attachment to a conventional junction box, an inner disk below and parallel to said outer disk; screw means connecting said disks together, a bracket fixed to said inner disk, resilient clips fixed to said bracket, a ring-type fluorescent fixture held in said clips, a ballast, a starter, and means attaching said socket, ballast and starter to said bracket.

2. A lighting fixture according to claim 1 which said base is formed with an inward-slanted wall having an annular flange at its inner end, said inner disk fitting on top of said annular flange.

3. A lighting fixture according to claim 1 which further comprises a junction box having a conduit terminating therein and conduit wires in said conduit, said box having an outer face, means detachably connecting said outer disk to said outer face, fixture wires extending from said box into said base and connected to said socket, and connectors in said box connecting said conduit wires to said fixture wires, said outer wall of said base enclosing said box.

4. A lighting fixture according to claim 1 which further comprises a post, a post socket fitting on top of said post, an outward-inward slanted flange on said post socket, said annular flange of said base resting on said slanted flange, a pair of wings outside said post socket, the outer edge of each wing bearing down on said annular flange, and a screw threaded into each said wing and extending through said slanted flange and having a bead below said slanted flange, whereby by turning the head of said screw said wing is drawn down to clamp said annular flange tightly to said slanted flange.

* * * * *